US010513765B2

(12) United States Patent
Cha et al.

(10) Patent No.: US 10,513,765 B2
(45) Date of Patent: Dec. 24, 2019

(54) STAINLESS STEEL HAVING EXCELLENT OXIDATION RESISTANCE AT HIGH TEMPERATURE

(71) Applicant: HYUNDAI MOTOR COMPANY, Seoul (KR)

(72) Inventors: Sung Chul Cha, Seoul (KR); Ik Soo Kim, Yongin-si (KR); Young Joon Kang, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 395 days.

(21) Appl. No.: 15/377,785

(22) Filed: Dec. 13, 2016

(65) Prior Publication Data

US 2018/0100221 A1 Apr. 12, 2018

(30) Foreign Application Priority Data

Oct. 12, 2016 (KR) ..... 10-2016-0132108

(51) Int. Cl.

| | |
|---|---|
| ***C22C 38/58*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/54*** | (2006.01) |

(52) U.S. Cl.

CPC ..... *C22C 38/58* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/52* (2013.01); *C22C 38/54* (2013.01)

(58) Field of Classification Search

CPC ..... C22C 38/04; C22C 38/06; C22C 38/44; C22C 38/46; C22C 38/48; C22C 38/52; C22C 38/54; C22C 38/58

USPC ..... 420/38

See application file for complete search history.

(56) References Cited

U.S. PATENT DOCUMENTS

| | | | | |
|---|---|---|---|---|
| 4,581,067 A * | 4/1986 | Iijima | C22C 38/58 420/48 |
| 2009/0169418 A1* | 7/2009 | Rautio | B01J 3/008 420/586.1 |
| 2015/0083283 A1* | 3/2015 | Inoue | C21D 9/46 148/610 |

FOREIGN PATENT DOCUMENTS

| | | |
|---|---|---|
| JP | 2005023353 A | 1/2005 |
| JP | 2007-016305 A | 1/2007 |

(Continued)

OTHER PUBLICATIONS

Translation of JP2005023353A, Jan. 2005 (Year: 2005).*

*Primary Examiner* — Jie Yang

(74) *Attorney, Agent, or Firm* — McDonnell Boehnen Hulbert & Berghoff LLP

(57) ABSTRACT

Disclosed herein is stainless steel having excellent tensile strength, fatigue strength, oxidation resistance at high temperature environment. According to an exemplary embodiment of the present invention, the stainless steel having excellent oxidation resistance at high temperature includes C: 0.01 to 0.2%, Si: 0.1 to 1.0%, Mn: 0.1 to 2.0%, Cr: 12.0 to 30.0%, V: 0.01 to 0.5%, Nb: 0.01 to 0.5%, Al: 0.1 to 4.0%, Co: 0.01 to 5.0%, Mo: 0.01 to 4.0%, W: 0.01 to 4.0%, B: 0.001 to 0.15%, Ni: 5.0 to 20.0% as wt %, the balance Fe, and other inevitable impurities.

11 Claims, 6 Drawing Sheets

(56) References Cited

FOREIGN PATENT DOCUMENTS

| | | | |
|---|---|---|---|
| KR | 10-2006-0015078 | | 2/2006 |
| KR | 20150126053 | A | 11/2015 |

* cited by examiner

[FIG.1]

| DIVISION (wt%) | No. | Cr | V | Nb | Al | Co | Mo | W | B | Ni |
|---|---|---|---|---|---|---|---|---|---|---|
| EXISTING STEEL | SUS304L | 18 | - | - | - | - | - | - | - | 10 |
| | SUS310S | 25 | - | - | - | - | - | - | - | 21 |
| EXAMPLE | #1 | 12.1 | 0.02 | 0.03 | 0.11 | 0.02 | 0.03 | 0.02 | 0.003 | 5.2 |
| | #2 | 29.7 | 0.48 | 0.49 | 3.98 | 4.96 | 3.95 | 3.94 | 0.14 | 19.9 |
| COMPARATIVE EXAMPLE | #1 | 11.7 | 0.11 | 0.29 | 1.51 | 3.77 | 3.81 | 0.91 | 0.09 | 18.4 |
| | #2 | 30.4 | 0.23 | 0.47 | 2.35 | 1.65 | 1.93 | 2.16 | 0.14 | 16.9 |
| | #3 | 12.1 | 0.008 | 0.15 | 0.46 | 0.23 | 2.64 | 1.68 | 0.03 | 15.5 |
| | #4 | 20.3 | 0.51 | 0.33 | 3.93 | 2.44 | 0.25 | 2.44 | 0.005 | 6.2 |
| | #5 | 13.5 | 0.35 | 0.007 | 0.22 | 3.53 | 3.49 | 0.92 | 0.1 | 8.3 |
| | #6 | 21.7 | 0.47 | 0.52 | 2.56 | 4.96 | 1.32 | 3.85 | 0.11 | 11.6 |
| | #7 | 14.9 | 0.12 | 0.02 | 0.08 | 1.48 | 1.74 | 0.44 | 0.003 | 16.5 |
| | #8 | 22.2 | 0.34 | 0.25 | 4.05 | 0.55 | 0.97 | 2.98 | 0.05 | 14.7 |
| | #9 | 15.4 | 0.26 | 0.38 | 0.97 | 0.007 | 2.15 | 1.62 | 0.1 | 19.4 |
| | #10 | 24.6 | 0.48 | 0.16 | 2.58 | 5.04 | 3.94 | 3.86 | 0 | 13.1 |
| | #11 | 16.8 | 0.33 | 0.43 | 1.75 | 0.91 | 0.009 | 1.99 | 0.14 | 11.2 |
| | #12 | 26.5 | 0.24 | 0.34 | 3.84 | 1.86 | 4.05 | 2.64 | 0.13 | 8.9 |
| | #13 | 17.9 | 0.19 | 0.11 | 0.64 | 3.63 | 1.69 | 0.008 | 0.06 | 6.5 |
| | #14 | 27.6 | 0.06 | 0.08 | 3.36 | 2.22 | 2.45 | 4.03 | 0.009 | 5.2 |
| | #15 | 18.2 | 0.04 | 0.22 | 1.47 | 3.55 | 0.97 | 2.63 | 0.0009 | 18.6 |
| | #16 | 28.3 | 0.31 | 0.46 | 2.62 | 2.7 | 3.89 | 0.24 | 0.16 | 11.7 |
| | #17 | 19.4 | 0.43 | 0.07 | 1.74 | 4.49 | 0.48 | 3.48 | 0.12 | 4.9 |
| | #18 | 29.5 | 0.01 | 0.15 | 3.95 | 3.65 | 2.92 | 1.35 | 0.14 | 20.2 |

[FIG.2]

| DIVISION (wt%) | No. | TENSILE STRENGTH (20°C) MPa | TENSILE STRENGTH (650°C) MPa | A5 ELONGATION (650°C) % | FATIGUE STRENGTH (650°C, $10^7$ TIMES) MPa | OXIDATION WEIGHTING (650°C/100h) $g/m^2$ |
|---|---|---|---|---|---|---|
| EXISTING STEEL | SUS304L | 535 | 190 | 46 | 62 | 2.22 |
| | SUS310s | 624 | 220 | 56 | 78 | 1.73 |
| EXAMPLE | #1 | 712 | 258 | 54 | 97 | 0.81 |
| | #2 | 760 | 270 | 52 | 105 | 0.41 |
| COMPARATIVE EXAMPLE | #1 | 669 | 197 | 49 | 56 | 2.06 |
| | #2 | 622 | 183 | 56 | 62 | 0.46 |
| | #3 | 575 | 176 | 47 | 59 | 1.28 |
| | #4 | 657 | 251 | 45 | 85 | 1.14 |
| | #5 | 594 | 155 | 55 | 51 | 1.32 |
| | #6 | 678 | 242 | 41 | 102 | 1.25 |
| | #7 | 611 | 148 | 58 | 53 | 0.86 |
| | #8 | 556 | 209 | 44 | 62 | 0.68 |
| | #9 | 643 | 166 | 51 | 56 | 0.94 |
| | #10 | 652 | 194 | 40 | 99 | 1.01 |
| | #11 | 584 | 161 | 57 | 67 | 1.75 |
| | #12 | 698 | 238 | 41 | 74 | 1.36 |
| | #13 | 594 | 215 | 56 | 58 | 1.12 |
| | #14 | 705 | 221 | 37 | 66 | 1.09 |
| | #15 | 616 | 154 | 36 | 82 | 0.72 |
| | #16 | 609 | 206 | 49 | 95 | 0.65 |
| | #17 | 667 | 219 | 42 | 58 | 2.08 |
| | #18 | 604 | 258 | 46 | 91 | 0.44 |

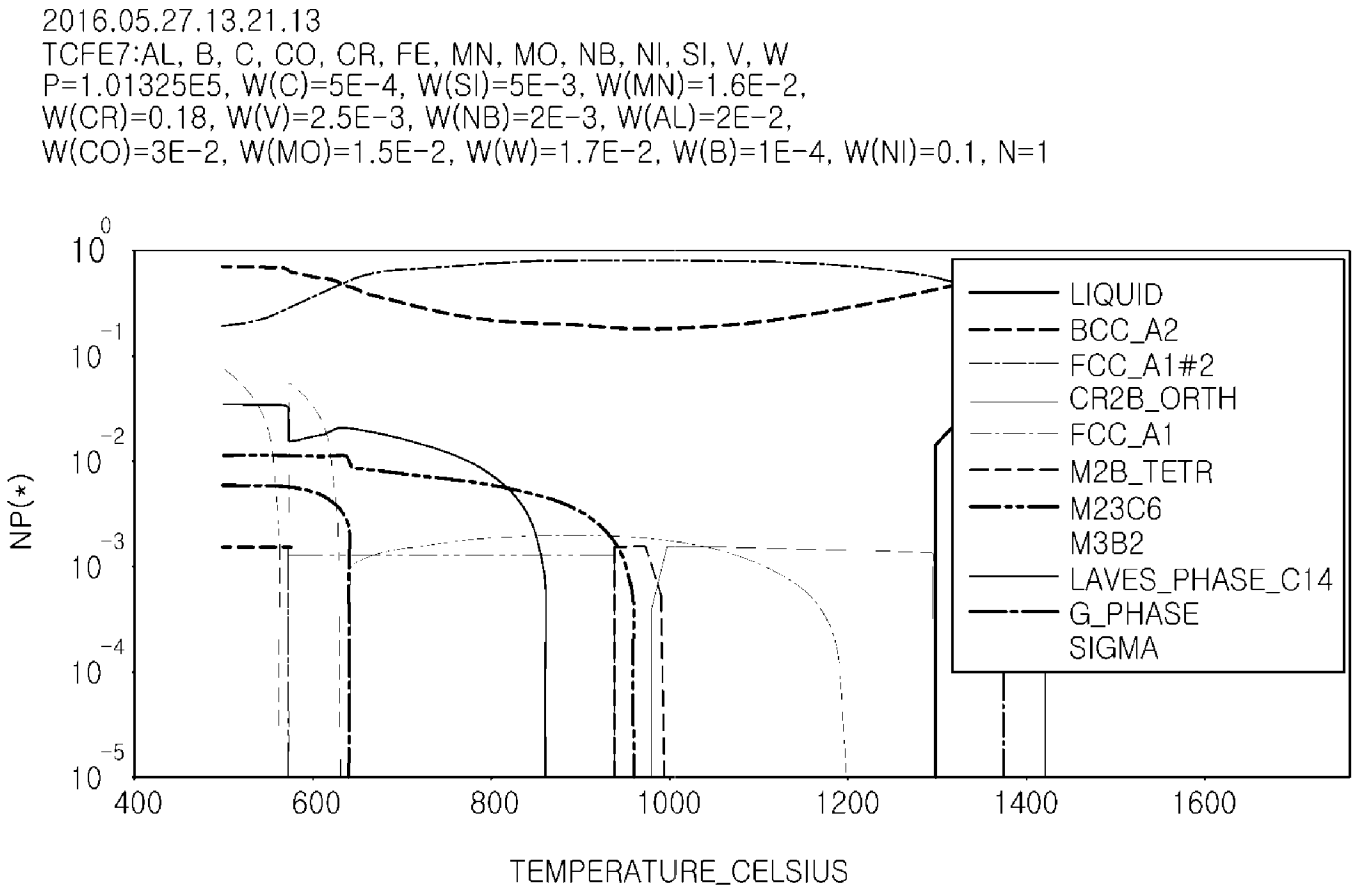
[FIG. 3]

[FIG.4A]
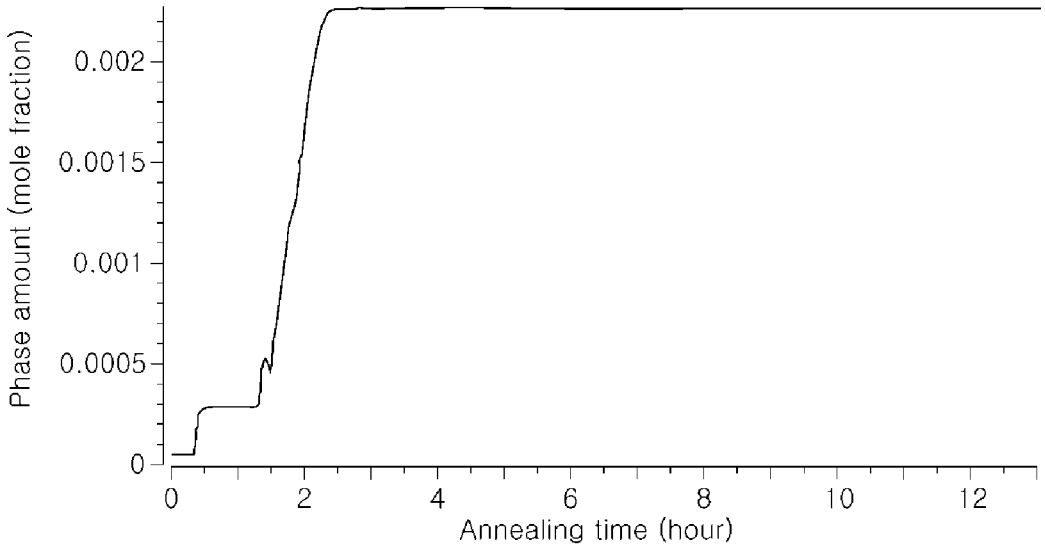
[FIG.4B]
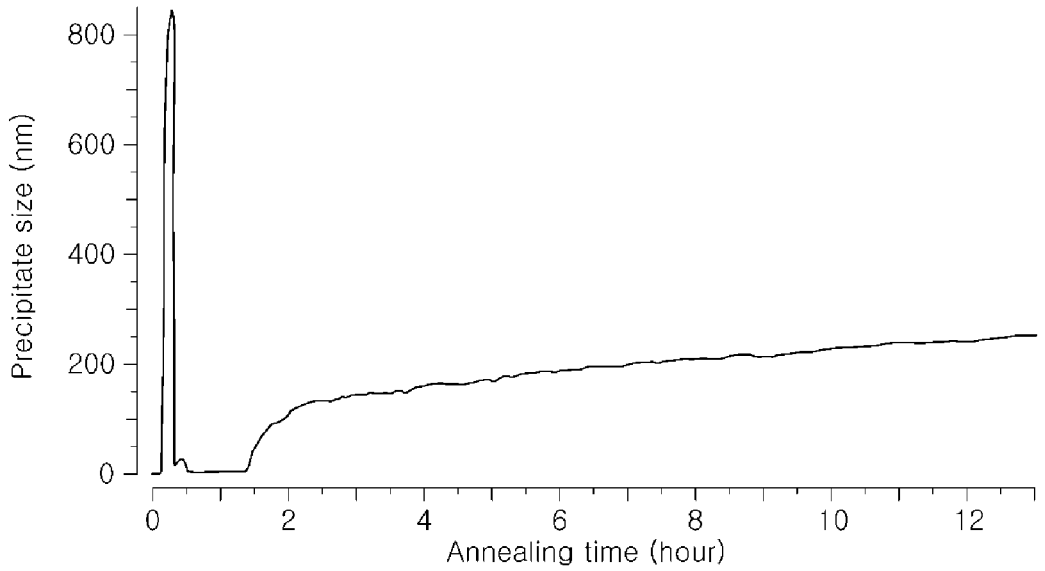

[FIG.5A]
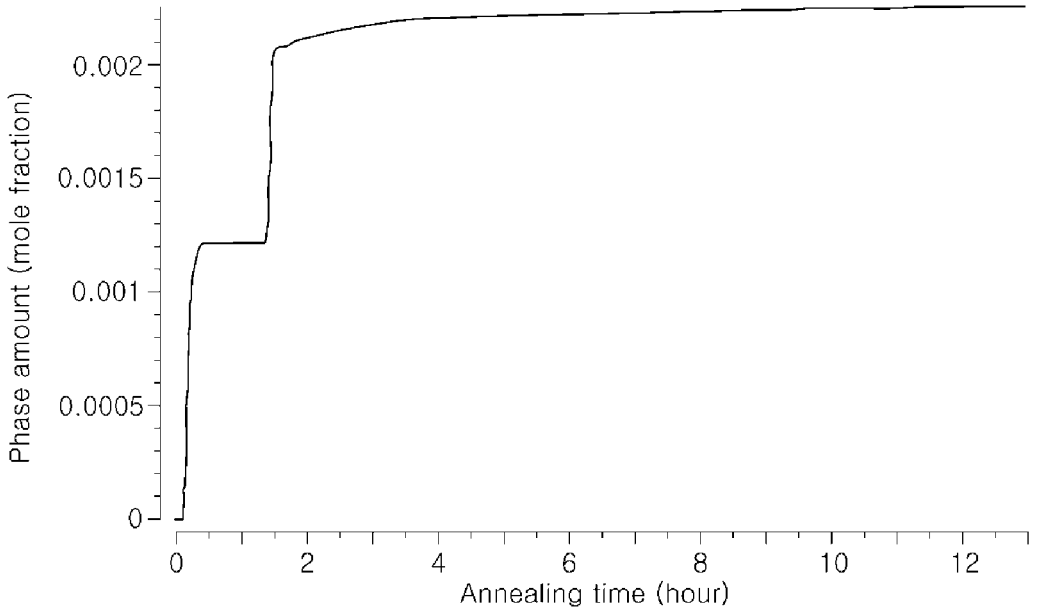
[FIG.5B]
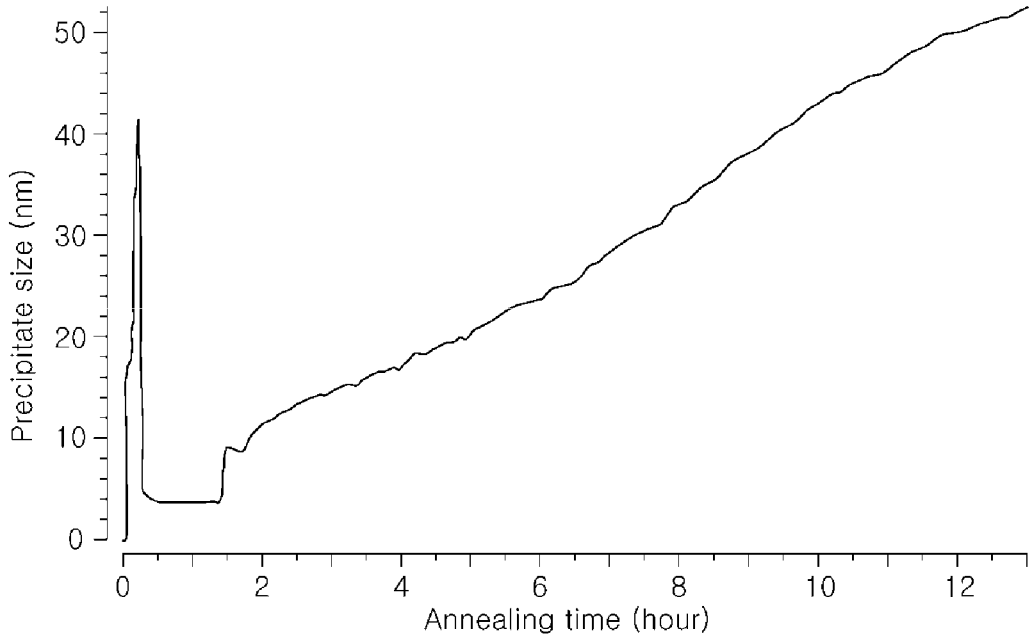

[FIG.6]
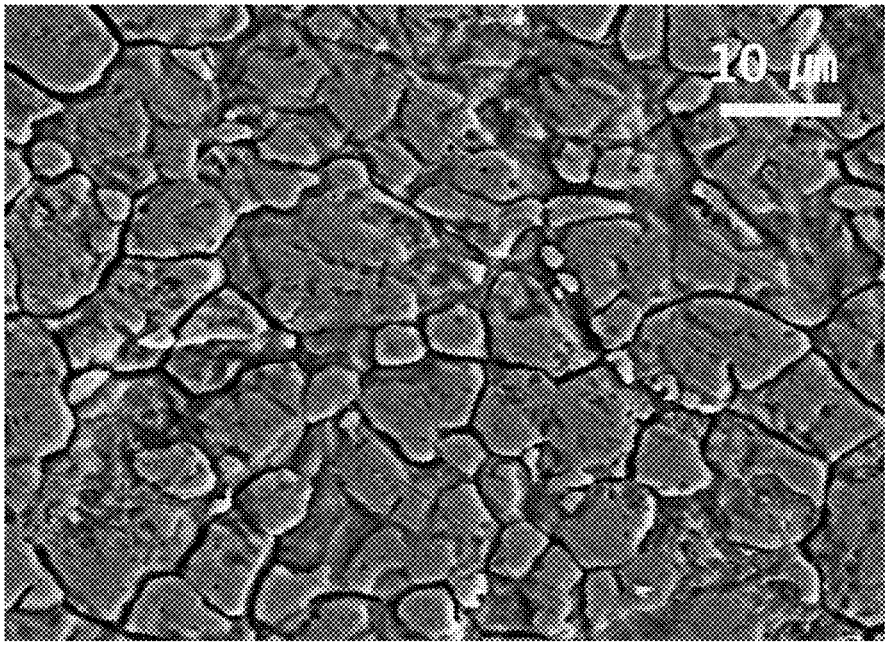
[FIG.7]
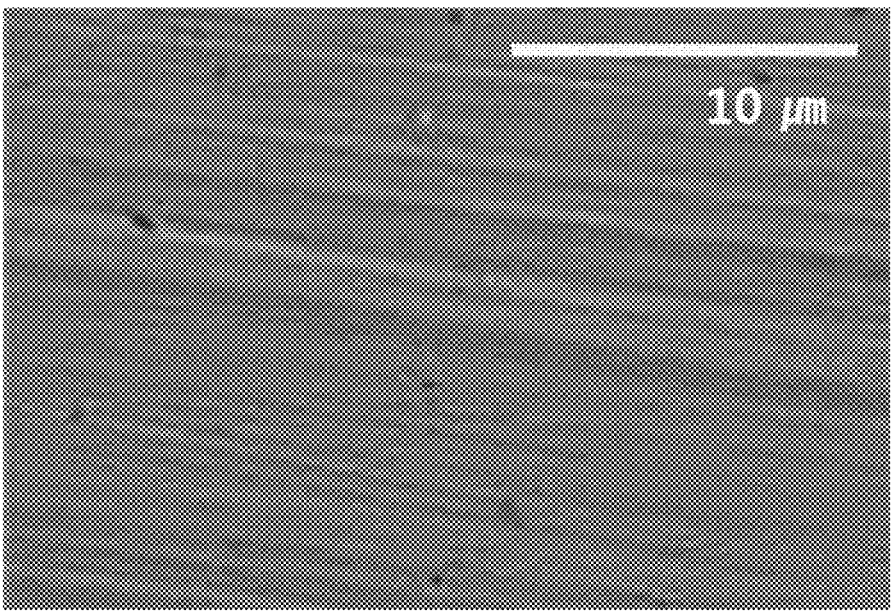

STAINLESS STEEL HAVING EXCELLENT OXIDATION RESISTANCE AT HIGH TEMPERATURE

CROSS REFERENCE TO RELATED APPLICATION

The present application claims benefit of and priority to Korean Patent Application No. 10-2016-0132108 filed on Oct. 12, 2016, the entire contents of which is incorporated herein for all purposes by this reference.

BACKGROUND OF THE INVENTION

Field of the Invention

The present invention relates to stainless steel having excellent oxidation resistance at high temperature, and more particularly, to stainless steel having excellent tensile strength, fatigue strength, and oxidation resistance in a high temperature environment.

Description of the Related Art

As fossil fuel reserves reach their natural limit, there is a growing interest in improving the fuel efficiency of vehicles due to the high variability of international oil prices.

In response, various technologies for improving vehicle fuel efficiency have been researched. One accepted method for improving fuel efficiency is reducing the vehicles weight.

Technologies for reducing vehicle weight have also been researched for a variety of applications other than improving fuel efficiency. For example, technologies for reducing a vehicle's size while increasing engine output have been developed. In these applications, however, the temperature of the exhaust gas rises with increased engine output in a smaller engine, leads to diminished durability of the parts in the exhaust line.

To address this problem, modifications of the exhaust line using stainless steel have been introduced, but conventional stainless steel has insufficient strength and oxidation resistance in the high temperature environment of a vehicle exhaust line.

Attempts have been made to address the disadvantages of using stainless steel by forming a coating layer on a surface of the stainless steel, but lead to an undesirable increase in manufacturing costs.

SUMMARY OF THE INVENTION

The present disclosure has been made keeping in mind the above problems occurring in the related art. The present disclosure provides a stainless steel having excellent tensile strength, fatigue strength, and oxidation resistance in a high temperature environment, made by optimizing the composition of the alloy to generate a stable composite carbide and composite boride within a structure.

In order to achieve the above object, according to one aspect of the present invention, the improved stainless steel comprises an alloy having the following composition: C: 0.01 to 0.2%, Si: 0.1 to 1.0%, Mn: 0.1 to 2.0%, Cr: 12.0 to 30.0%, V: 0.01 to 0.5%, Nb: 0.01 to 0.5%, Al: 0.1 to 4.0%, Co: 0.01 to 5.0%, Mo: 0.01 to 4.0%, W: 0.01 to 4.0%, B: 0.001 to 0.15%, Ni: 5.0 to 20.0% as wt %, with the remainder of the alloy comprising Fe and a small amount of impurities.

The structure of the stainless steel may include NbC and $(Cr,Mo)_{23}C_6$ as composite carbide and $(Cr,Fe)_2B$ as composite boride.

The structure of the stainless steel may further include at least one of $(Mo,Cr,W)_2B$ and $(Mo,W)_3B_2$ as the composite boride.

In an example embodiment, the size of the composite carbide is equal to or less than 50 nm.

In further example embodiments, the stainless steel may have the following characteristics at temperatures above room temperature: a tensile strength greater than or equal to 250 MPa, a fatigue strength greater than or equal to 95 MPa, and an oxidation weighting less than or equal to 0.9 g/m$^2$.

The improved stainless steel may have a room-temperature tensile strength greater than or equal to 710 MPa and an A5 elongation greater than or equal to 50%.

BRIEF DESCRIPTION OF THE DRAWINGS

The above and other objects, features and advantages of the present invention will be more clearly understood from the following detailed description taken in conjunction with the accompanying drawings, in which:

FIG. 1 is a table showing the components of an example embodiment and a comparative example embodiment;

FIG. 2 is a table showing the physical properties and performance of the example embodiment and comparative example embodiment described in FIG. 1;

FIG. 3 is a graph showing phase transformations by temperature for an improved stainless steel according to an example embodiment;

FIGS. 4A and 4B are graphs showing a molar fraction and a size of carbide as a function of annealing time for a conventional stainless steel (SUS310);

FIGS. 5A and 5B are graphs showing a molar fraction and a size of composite carbide as a function of annealing time for an example embodiment of the improved stainless steel of the present disclosure;

FIG. 6 is a picture showing oxidation properties of a conventional stainless steel (SUS304); and FIG. 7 is a picture showing oxidation properties of an example embodiment of the improved stainless steel of the present disclosure.

DESCRIPTION OF PREFERRED EMBODIMENTS

Hereinafter, example embodiments are described in detail with reference to the accompanying drawings. However, the present invention is not limited to exemplary embodiments disclosed below, but may be implemented in various different forms. These example embodiments are provided only in order to make the disclosure of the present invention complete and allow those skilled in the art to recognize the scope of the present disclosure.

Stainless steel having excellent oxidation resistance at high temperatures according to an example embodiment of the present disclosure is desirable for use for a vehicle exhaust line, because it improved physical properties such as high tensile strength, high fatigue strength, and high oxidation resistance in the high temperature environment of the exhaust line. These characteristics can be achieved by optimizing the composition of the stainless steel. In an example embodiment, the improved stainless steel comprises: C: 0.01 to 0.2%, Si: 0.1 to 1.0%, Mn: 0.1 to 2.0%, Cr: 12.0 to 30.0%, V: 0.01 to 0.5%, Nb: 0.01 to 0.5%, Al: 0.1 to 4.0%, Co: 0.01 to 5.0%, Mo: 0.01 to 4.0%, W: 0.01 to 4.0%, B: 0.001 to 0.15%, Ni: 5.0 to 20.0% as wt %, with the remainder comprising Fe, and a small amount of impurities.

The ranges for each of the alloy components are selected based on the properties described below. Hereinafter, unless specially mentioned, % refers to wt % of the specific element in the composition.

Carbon (C): 0.01 to 0.2%

Addition of carbon (C) in the stated ranges serves to increase strength and hardness of the stainless steel. In particular, composite carbides such as NbC and $(Cr,Mo)_{23}C_6$ are formed, improving overall corrosion resistance and resistance of the grain boundary to corrosion. In addition, oxidation resistance is improved due to grain boundary sensitization between 450 and 850° C.

When the content of carbon C is less than 0.01%, the less carbide is generated and there is a corresponding reduction in strength. On the other hand, when the content of carbon (C) exceeds 0.2%, grain boundary sensitization may be increased excessively. Therefore, it is preferable to limit the content of carbon (C) to a range of 0.01 to 0.2%.

Silicon (Si): 0.1 to 1.0%

Addition of silicon (Si) in the stated ranges serves as a deoxidizer and serves to control elongation. In particular, adding silicon in the stated ranges improves oxidation resistance, stress corrosion cracking (SCC) properties, and moldability.

When the content of silicon (Si) is less than 0.1%, oxidation resistance and moldability of the stainless steel may be reduced. On the other hand, when the content of silicon (Si) exceeds 1.0%, flexibility and weldability of the stainless steel may be reduced. Therefore, it is preferable to limit the content of silicon (Si) to a range of 0.1 to 1.0%.

Manganese (Mn): 0.1 to 2.0%

Addition of manganese (Mn) in the stated ranges serves to improve strength. In particular, the manganese (Mn) increases hardenability, nitrogen (N) solubility, and yield strength and reduces the cooling speed of the stainless steel.

When the content of manganese (Mn) is less than 0.1%, the hardness of the stainless steel is reduced. On the other hand, when the content of manganese (Mn) exceeds 2.0%, it reduces the beneficial effects of the other components. Therefore, it is preferable to limit the content of manganese (Mn) to a range of 0.1 to 2.0%.

Chromium (Cr): 12.0 to 30.0%

Addition of chromium (Cr) in the stated ranges enhances the corrosion resistance of the improved stainless steel, And, along with nickel and manganese, helps to stabilize austenite in the stainless steel. In particular, the chromium Cr serves to increase corrosion resistance, high-temperature strength, and non-magnetism and also serves as a solid-solution reinforcing agent.

When the content of chrome (Cr) is less than 12.0%, the oxidation resistance and the structural stability of the stainless steel may be reduced. On the other hand, when the content of chrome (Cr) exceeds 30.0%, it reduces the beneficial effects of other elements. Therefore, it is preferable to limit the content of chrome (Cr) to a range of 12.0 to 30.0%.

Vanadium (V): 0.01 to 0.5%

Addition of vanadium (V) in the stated ranges serves as a solid-solution reinforcing agent and provides increased strength of a low temperature section. Vanadium also serves to increase hardenability of the stainless steel.

When the content of vanadium (V) is less than 0.01%, the low temperature strength and the micro structural refinement may be reduced. On the other hand, when the content of vanadium (V) exceeds 0.5%, the beneficial effects of niobium (Nb) may be reduced. Therefore, it is preferable to limit the content of vanadium (V) to a range of 0.01 to 0.5%.

Niobium (Nb): 0.01 to 0.5%

Addition of niobium (Nb) in the stated ranges improves corrosion resistance, resistance of grain boundary to corrosion, and heat resistance. In particular, the niobium increases high-temperature strength, generates carbide in γ' phase having excellent mechanical physical properties, generates ferrite, and suppresses formation of a γ phase and a laves phase. Further, when the content of niobium (Nb) is high, heat resistance is also increased.

When the content of niobium (Nb) is less than 0.01%, the low temperature strength and the weldability of the stainless steel may be reduced. On the other hand, when the content of niobium (Nb) exceeds 0.5%, it reduces the beneficial effects of carbides other than niobium carbide. Therefore, it is preferable to limit the content of niobium (Nb) to a range of 0.01 to 0.5%.

Aluminum (Al): 0.1 to 4.0%

Aluminum (Al), when added in the stated ranges, serves as a solid-solution reinforcing agent. Aluminum also provides oxidation resistance and improves the mechanical physical properties of the stainless steel.

When the content of aluminum (Al) is less than 0.1%, the high-temperature strength and the structural uniformity of the stainless steel may be reduced. On the other hand, when the content of aluminum (Al) exceeds 4.0%, generation of desirable carbide may be reduced. Therefore, it is preferable to limit the content of aluminum (Al) to a range of 0.1 to 4.0%.

Cobalt (Co): 0.01 to 5.0%

Addition of Cobalt in the stated ranges (Co) prevents undesirable grain size effects at high temperature. Cobalt increases creep strength and tempering physical properties.

When the content of cobalt (Co) is less than 0.01%, there is minimal effect on grain size at high temperature and the creep strength is reduced. On the other hand, when the content of cobalt (Co) exceeds 5.0%, it reduces the beneficial effects of other elements. Therefore, it is preferable to limit the content of cobalt (Co) to a range of 0.01 to 5.0%.

Molybdenum (Mo): 0.01 to 4.0%

Addition of molybdenum (Mo) in the stated ranges improves corrosion resistance. In particular, the molybdenum forms carbide and improves mechanical physical properties, fitting resistance, and crack resistance.

When the content of molybdenum (Mn) is less than 0.01%, less carbide is produced, and thus strength of the stainless steel may be reduced. Addition of molybdenum (Mn) at amounts exceeding 4.0% does not lead to additional beneficial effects; instead the improvement due to molybdenum reaches a saturation point where the effects plateau. Therefore, it is preferable to limit the content of molybdenum (Mo) to a range of 0.01 to 4.0%.

Tungsten (W): 0.01 to 4.0%

Tungsten (W), when added in the stated ranges serves as a solid-solution reinforcing agent. In particular, tungsten carbide suppresses grain boundary sliding and Cl oxidation, is involved in a generation of a γ phase and a μ phase, prevents undesirable grain size effects and suppresses the grain from being huge.

When the content of tungsten W is less than 0.01%, the strength of the stainless steel may be reduced and undesirable grain size effects may occur. On the other hand, if the content of tungsten (W) exceeds 4.0%, the stainless steel may become more brittle. Therefore, it is preferable to limit the content of tungsten (W) to a range of 0.01 to 4.0%.

Boron (B): 0.001 to 0.15%

Addition of boron (B) in the stated ranges reinforces grain boundary hardness. In particular, the boron (B) improves the creep strength and the flexibility of the stainless steel.

When the content of boron (B) is less than 0.001%, the creep strength and the flexibility may deteriorate. Addition of boron (B) at amounts exceeding 0.15% does not lead to additional beneficial effects; instead the improvement due to boron reaches a saturation point where the effects plateau. Therefore, it is preferable to limit the content of boron (B) to a range of 0.001 to 0.15%.

Nickel (Ni): 5.0 to 20.0%

Addition of nickel (Ni) in the stated ranges improves corrosion resistance and heat resistance of the stainless steel. In particular, the nickel increases non-magnetism, oxidation resistance, high-temperature strength, hardenability, and temperature resistance.

When the content of nickel (Ni) is less than 5.0%, the heat resistance and the high-temperature strength may be reduced and a phase may not be generated. On the other hand, when the content of nickel (Ni) exceeds 20.0%, manufacturing costs may be increased and a very high temperature effect may be unnecessarily increased. Therefore, it is preferable to limit the content of nickel (Ni) to a range of 5.0 to 20.0%.

Meanwhile, the remainder other than the above components is primarily Fe and a small amount of impurities.

Hereinafter, the present invention is described with reference to two example embodiments.

An experiment was performed on samples in which stainless steel produced according to a standard commercial process was subjected to heat treatment. Specifically, the samples were manufactured by performing hot band annealing, cold rolling, and cold band annealing on a hot rolled sheet that suffers from hot roughing rolling and hot finishing rolling from a continuous cast slab using molten steel produced while the content of each component is changed.

Each sample was prepared by performing solid solution heat treatment at 1010 to 1150° C. and quenching on each of the samples. However, in the present experiment, the content of C, Si, and Mn were determined to not have a direct effect on the characteristics being tested. Therefore, in FIG. 1, the content of C, Si, and Mn was not shown but the Examples and Comparative Example had compositions in the following ranges: C: 0.01 to 0.2%, Si: 0.1 to 1.0%, and Mn: 0.1 to 2.0%.

Next, a test for confirming the physical properties of the conventional stainless steel produced as described above and the samples according to Example and Comparative Example is described.

The conventional stainless, the Example and the Comparative Example were tested for room-temperature tensile strength (20° C.), high-temperature tensile strength (650° C.), A5 elongation (650° C.), fatigue strength (650° C.), and oxidation weighting and the results are illustrated in FIG. 2.

The measurement of the room-temperature and high-temperature tensile strength was performed on each sample using a 20-ton tester according to Korean testing standard KS B 0802. A5 elongation was measured at a temperature of 650° C. Fatigue strength was measured using rotating beam fatigue testing on the samples at a temperature of 650° C. according to Korean testing standard KS B ISO 1143.

Oxidation weighting was measured by preparing each sample and then measuring a pre-test weight. The sample was then maintained for 100 hours at 650° C. Each sample was exposed to $N_2$ (20%), $O_2$ (10%), and $H_2O$. After 100 hours elapsed time, the weight of the sample was measured again and the oxidation weighting was obtained by comparing the weights of the sample before and after treatment.

As shown in FIG. 2, conventional stainless steels SUS304L and SUS310S do not contain V, Nb, Al, Co, Mo, W, B, or Ni and therefore do not demonstrate the improved characteristics relating to room-temperature and high-temperature tensile strength, A5 elongation, fatigue strength, and oxidation weighting.

Examples 1 and 2 have compositions as described for example embodiments of the present disclosure. Examples 1 and 2 each have a tensile strength at high temperatures (e.g., 650° C.) above room temperature (20° C.) greater than or equal to 250 MPa, a fatigue strength is greater than or equal to 95 MPa, and an oxidation weighting less than or equal to 0.9 g/m$^2$. Further, Examples 1 and 2 also had a room temperature (20° C.) tensile strength greater than or equal to 710 MPa and an A5 elongation greater than 50%.

Comparative Examples 1 to 18 are examples where the compositions have at least one component outside the stated ranges for the example embodiments. For example, Comparative Example 1 has a chromium content below the required range, and Comparative Example 2 has a chromium content above the required range. While these compositions exhibited partially improved room-temperature and high-temperature tensile strength, A5 elongation, fatigue strength, and oxidation weighting compared to conventional stainless steel, they did not reach the levels of improvement demonstrated by Examples 1 and 2.

In particular, Comparative Example 2 has a chromium content of higher than the required range, Comparative Example has an aluminum contact higher than the required range, Comparative Examples 15 and 16 have a boron content below the required range and above the required range respectively, and Example 18 has a nickel content below the required range. In these Comparative Examples, while testing showed that the oxidation weighting was below 0.9 g/m$^2$, in accordance with the desired ranges disclosed herein, these Comparative Examples did not meet other desired performance criteria. Comparative Examples 2, 8, 15 and 16 do not have the high-temperature tensile strength of greater than or equal to 250 MPa as was achieved by the example embodiments according to the present disclosure. Comparative Examples 2, 8, 15 and 18 do not have the fatigue strength of greater than or equal to 95 MPa achieved by the example embodiments according to the present disclosure.

Comparative Examples 6 and 10 respectively do not have niobium and cobalt content in the required ranges. While these Comparative Examples had fatigue strengths in the desired range of greater than or equal to 95 MPa, the tested oxidation weightings were above the desired 0.9 g/m$^2$ limit disclosed herein and the tested high-temperature tensile strength was below the desired range of greater than or equal to 250 MPa.

FIG. 3 is graph showing the phase transformations by temperature of an example embodiment of the disclosed improved stainless steel. During alloying, when the amounts of the various components are within the ranges described above, various composite carbides and composite borides are formed. These composites lead to improved high-temperature tensile strength and fatigue strength and a reduction in the oxidation weighting. As described FIG. 3, FCC_A1#2 refers to a niobium carbide ("NbC"), Cr2B_ORTH refers to a composite boride such as $(Cr,Fe)_2B$, M2B_TETR refers to a composite boride such $(Mo, Cr, W)_2B$, M23C6 refers to a composite carbide such $(Cr,Mo)_{23}C_6$, and M3B2 refers to a composite boride such as $(Mo,W)_3B_2$.

FIGS. 4A and 4B show a molar fraction and a carbide size formed in a conventional stainless steel (SUS310) as a function of annealing time. FIGS. 5A and 5B, by comparison, show a molar fraction and a carbide size as a function of annealing time for an example improved stainless steel as described herein.

As can be appreciated from FIGS. 4A, 4B, 5A and 5B, in the case of the conventional SUS 310 stainless steel, carbide was generated at about 0.25% (molar fraction) but the size thereof reached a maximum of about 200 nm. On the other hand, in the Examples of the improved stainless steel, while carbide was still generated at about 0.25% (molar fraction), the carbide size was substantially lower for the same annealing times, reaching about 50 nm after 12 hours. The smaller carbide size contributes to the increase in tensile strength and fatigue strength and the reduction of oxidation weighting in a high temperature environment.

FIG. 6 is a picture showing testing results on oxidation properties of conventional stainless steel (SUS304) and FIG. 7 is a picture showing testing results on oxidation properties of stainless steel according to an example embodiment of the present disclosure. As can be appreciated from FIGS. 6 and 7, the conventional stainless steel cracked due to oxidation during the oxidation weighting measurement experiment, while the Example did not exhibit cracking due to oxidation.

According to the example embodiments of the present disclosure, the desired levels of composite carbide and composite boride may be achieved in the alloy by optimizing the content of the main alloy components, resulting in an improved stainless steel having a tensile strength greater than or equal to 250 MPa, a fatigue strength greater than or equal to 95 MPa, and an oxidation weighting less than or equal to 0.9 $g/m^2$ at in a high temperature environment.

The present invention is described with reference to the accompanying drawings and the foregoing exemplary embodiments but is not limited thereto and is limited by the following claims. The present invention may be variously changed and modified by those skilled in the art without departing from the technical sprit of claims to be described below.

What is claimed is:

1. An improved stainless steel, wherein the stainless steel consisting of:

between 0.01 and 0.2 weight % carbon;
between 0.01 and 0.1 weight % silicon;
between 0.1 and 2.0 weight % manganese;
between 12.0 and 30.0 weight % chromium;
between 0.01 and 0.5 weight % vanadium;
between 0.01 and 0.5 weight % niobium;
between 0.11 and 4.0 weight % aluminum;
between 0.01 and 5.0 weight % cobalt;
between 0.01 and 4.0 weight % molybdenum;
between 0.01 and 4.0 weight % tungsten;
between 0.001 and 0.15% boron; and
between 5.0 and 20.0% weight % nickel; and
wherein the remaining weight percent is comprised substantially of iron and a small amount of impurities.

2. The improved stainless steel of claim 1, wherein the stainless steel forms niobium carbide, composite carbide and composite boride structures.

3. The improved stainless steel of claim 2, wherein the composite carbide is (Cr,Mo)23C6.

4. The improved stainless steel of claim 2, wherein the composite boride is (Cr,Fe)2B.

5. The improved stainless steel of claim 2, wherein the structure of the stainless steel further includes at least one of (Mo,Cr,W)2B and (Mo,W)3B2 as the composite boride.

6. The improved stainless steel of claim 2, wherein the particle size of the composite carbide is less than or equal to 50 nm.

7. The improved stainless steel of claim 1, wherein the stainless steel has a tensile strength at temperatures above room temperature greater than or equal to 250 MPa.

8. The improved stainless steel of claim 1, wherein the stainless steel has a fatigue strength greater than or equal to 95 MPa.

9. The improved stainless steel of claim 1, wherein the stainless steel has an oxidation weighting less than or equal to 0.9 $g/m^2$.

10. The improved stainless steel of claim 1, wherein the stainless steel has a tensile strength at temperatures above room temperature greater than or equal to 250 MPa; a fatigue strength greater than or equal to 95 MPa; and an oxidation weighting less than or equal to 0.9 $g/m^2$.

11. The stainless steel of claim 1, wherein the stainless steel has a room-temperature tensile strength greater than or equal to 710 MPa and an A5 elongation according to ASTM A370 standard test greater than or equal to 50%.

* * * * *